US011711644B2

(12) United States Patent
Wan

(10) Patent No.: US 11,711,644 B2
(45) Date of Patent: Jul. 25, 2023

(54) EARPHONE AND WORN DETECTION DEVICE THEREOF

(71) Applicant: GOERTEK TECHNOLOGY CO., LTD., Shandong (CN)

(72) Inventor: Shengguo Wan, Shandong (CN)

(73) Assignee: GOERTEK TECHNOLOG CO., LTD., Qingdao (CN)

( * ) Notice: Subject to any disclaimer, the term of this patent is extended or adjusted under 35 U.S.C. 154(b) by 259 days.

(21) Appl. No.: 17/296,643

(22) PCT Filed: Sep. 25, 2019

(86) PCT No.: PCT/CN2019/107901
§ 371 (c)(1),
(2) Date: May 25, 2021

(87) PCT Pub. No.: WO2020/108059
PCT Pub. Date: Jun. 4, 2020

(65) Prior Publication Data

US 2022/0021965 A1 Jan. 20, 2022

(30) Foreign Application Priority Data

Nov. 29, 2018 (CN) ..... 201811443557.7

(51) Int. Cl.
*H04R 29/00* (2006.01)
*H04R 1/10* (2006.01)

(52) U.S. Cl.
CPC ..... *H04R 1/1041* (2013.01); *H04R 29/00* (2013.01); *H04R 2460/03* (2013.01)

(58) Field of Classification Search
CPC ..... H04R 1/1041; H04R 29/00
See application file for complete search history.

(56) References Cited

U.S. PATENT DOCUMENTS

2018/0007994 A1* 1/2018 Boesen ..... A42B 3/30

FOREIGN PATENT DOCUMENTS

CN 202103814 1/2012
CN 108574897 9/2018
(Continued)

OTHER PUBLICATIONS

International Search Report issued in PCT/CN2019/107901 dated Dec. 26, 2019.

*Primary Examiner* — Simon King
(74) *Attorney, Agent, or Firm* — Workman Nydegger

(57) ABSTRACT

Disclosed by the present application are an earphone and a worn detection device thereof. The detection device comprises a sensing panel used for forming a battery encapsulated metal shell, a detection chip connected to an input end and the sensing panel and a control chip connected to an output end of the detection chip; a battery is arranged in an earphone handle of the earphone; the detection chip is used for detecting a sensing signal of the sensing panel and determining a wearing state of the earphone according to the sensing signal; and the control chip is used to adjust the working state of the earphone according to the wearing state. When a user wears the earphone, the earphone handle of the earphone contacts the skin of the user, a capacitance effect is formed between the sensing panel and the skin of the user, and a sensing signal is generated. The detection chip determines the wearing state of the earphone by means of the sensing signal, and the control chip adjusts the working state of the earphone according to the wearing state. The present application reuses the encapsulated metal shell as the sensing panel, which is conducive to the miniaturization of the earphone and the improvement of the sensitivity and reliability of detecting the wearing state.

19 Claims, 3 Drawing Sheets

(56) References Cited

FOREIGN PATENT DOCUMENTS

| | | |
|---|---|---|
| CN | 108882095 | 11/2018 |
| CN | 109348346 | 2/2019 |
| CN | 208462017 | 2/2019 |
| CN | 208940195 | 6/2019 |

* cited by examiner

EARPHONE AND WORN DETECTION DEVICE THEREOF

This application is the U.S. national phase of International Application No. PCT/CN2019/107901, titled "EARPHONE AND WORN DETECTION DEVICE THEREOF", filed on Sep. 25, 2019, which claims priority of Chinese Patent Application No. 201811443557.7, titled "EARPHONE AND WEAR DETECTION DEVICE THEREOF", filed with the China National Intellectual Property Administration on Nov. 29, 2018, both of which are incorporated herein by reference in their entirety.

FIELD

The present application relates to the technical field of portable listening devices, and in particular to an earphone and a wearing detection device thereof.

BACKGROUND

Due to the development of technology, the use of earphone has become more and more common in life of people. The Bluetooth earphone has become more and more popular, and the binaural wireless earphone has gradually emerged as well. The integration level thereof is getting higher and higher and the size thereof is getting smaller and smaller. In order to realize a longer battery life and a better user interaction experience, this type of earphone is usually equipped with a wearing detection function.

At present, the wearing detection function is usually realized by such means as infrared, laser or capacitive detection, but all the means take up considerable additional space.

The infrared detection may also affect the appearance design, and the capacitive detection requires a touch sensing panel and a detection chip to detect a sensing signal acquired by the touch sensing panel. However, the touch sensing panel in the capacitive detection usually requires additional space for installation, which is not conducive to the miniaturization of the earphone. Besides, due to the limited internal space of the earphone, a sensing area of the touch sensing panel is limited, limiting the detection sensitivity.

In view of this, a technical issue to be addressed presently by those skilled in the art is to provide an earphone and a wearing detection device thereof.

SUMMARY

A purpose of embodiments of the present disclosure is to provide an earphone and a wearing detection device thereof, which not only facilitates the miniaturization of an earphone, but also improves the sensitivity and reliability of wearing state detection during using.

In order to solve the above technical problems, an earphone wearing detection device is provided according to an embodiment of the present disclosure, the device including:

a sensing panel forming an encapsulating metal casing of a battery, a detection chip with an input terminal connected to the sensing panel, and a control chip connected to an output terminal of the detection chip, where the battery is arranged in an earphone stem of an earphone, the detection chip is configured to detect a sensing signal of the sensing panel, and determine a wearing state of the earphone according to the sensing signal, and the control chip is configured to adjust an operating state of the earphone according to the wearing state.

Optionally, the sensing panel is provided with a detection lug, a battery protection plate of the battery is provided with a detection interface corresponding to the detection lug, and the input terminal of the detection chip is connected to the detection lug through the detection interface, to connect the detection chip to the sensing panel.

Optionally, a surface of the sensing panel, for contact with skin of a user through a casing of the earphone stem when the earphone is worn, is an attaching surface, and an isolation layer is provided on an outside of each surface of the sensing panel except the attaching surface.

Optionally, the isolation layer is made of foam.

Optionally, the detection lug and positive and negative lugs provided on a battery cell of the battery are located on a same side surface of the sensing panel.

Optionally, the detection lug is located in the middle of the positive and negative lugs.

Optionally, the sensing panel is made with an aluminum-plastic film.

An earphone is also provided according to an embodiment of the present disclosure, including an earphone stem, a battery provided in the earphone stem, and the earphone wearing detection device described above.

Optionally, the earphone is a wireless Bluetooth earphone.

An earphone and a wearing detection device thereof are provided according to the embodiments of the present disclosure, including: a sensing panel forming a encapsulating metal casing of a battery, a detection chip with an input terminal connected to the sensing panel, and a control chip connected to an output terminal of the detection chip, where the battery is arranged in an earphone stem of an earphone. The detection chip is configured to detect a sensing signal of the sensing panel, and determine a wearing state of the earphone according to the sensing signal, and the control chip is configured to adjust an operating state of the earphone according to the wearing state.

It can be seen that a detection chip in the present disclosure is connected to an encapsulating metal casing of a battery provided inside an earphone stem of an earphone, and the encapsulating metal casing of the battery is multiplexed as a sensing panel. When a user wears the earphone, the earphone stem of the earphone is in contact with skin of the user, and a capacitance effect is formed between the sensing panel and the skin of the user, generating a sensing signal. Therefore a wearing state of the earphone may be determined by the detection chip through detecting the sensing signal of the sensing panel, so that the control chip may adjust an operating state of the earphone according to the wearing state. In the present disclosure, the encapsulating metal casing of the battery is multiplexed as a sensing panel without adding an additional sensing panel, which not only saves space and facilitates the miniaturization of the earphone, but also has a larger surface area of the battery and facilitates improving the sensitivity and reliability of wearing state detection.

BRIEF DESCRIPTION OF THE DRAWINGS

For more clearly illustrating embodiments of the present disclosure or the technical solutions in the conventional technology, drawings referred to for describing the embodiments or the conventional technology will be briefly described hereinafter. Apparently, drawings in the following description are only examples of the present disclosure, and for the person skilled in the art, other drawings may be obtained based on the set drawings without any creative efforts.

DETAILED DESCRIPTION OF THE EMBODIMENTS

An earphone and a wearing detection device thereof are provided according to the embodiments of the present disclosure, which not only facilitates the miniaturization of an earphone, but also improves the sensitivity and reliability of wearing state detection during using.

In order to make the objectives, technical solutions, and advantages of the embodiments of the present disclosure clearer, the technical solutions according to the embodiments of the present disclosure will be described clearly and completely as follows in conjunction with the drawings in the embodiments of the present disclosure. It is apparent that the described embodiments are only some embodiments of the disclosure, rather than all of the embodiments. Based on the embodiments of the present disclosure, all other embodiments acquired without creative efforts by those of ordinary skill in the art shall fall within the protection scope of the present disclosure.

Figure 1:
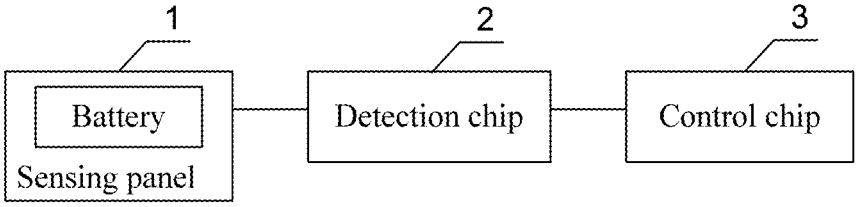
FIG. 1 is a schematic structural diagram of an earphone wearing detection device according to an embodiment of the present disclosure.

Reference is made to FIG. 1, which is a schematic structural diagram of an earphone wearing detection device according to an embodiment of the present disclosure. The wearing detection device includes:

a sensing panel 1 forming an encapsulating metal casing of a battery, a detection chip 2 with an input terminal connected to the sensing panel 1, and a control chip 3 connected to an output terminal of the detection chip 2, where the battery is arranged in an earphone stem of an earphone, where:

the detection chip 2 is configured to detect a sensing signal of the sensing panel 1, and determine a wearing state of the earphone according to the sensing signal; and the control chip 3 is configured to adjust an operating state of the earphone according to the wearing state.

Figure 2:
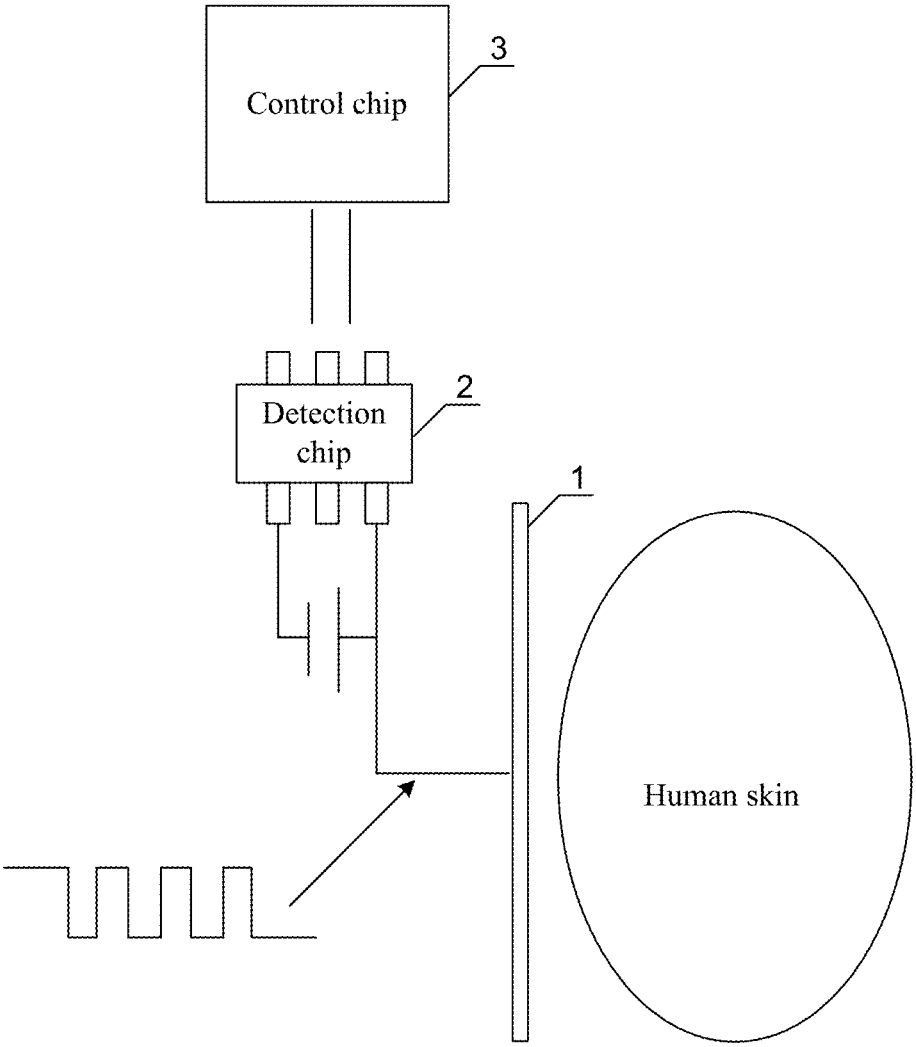
FIG. 2 is a schematic circuit diagram of an earphone wearing detection device according to an embodiment of the present disclosure.

It should be noted that the wearing detection device in the present disclosure is suitable for an earphone having a battery arranged inside an earphone stem, and the battery may be installed close to a casing of the earphone stem. The battery includes a battery cell 4, an encapsulating metal casing for encapsulating the battery cell 4, and a battery protection plate 5. In the present disclosure, the encapsulating metal casing of the battery is used as the sensing panel 1 for capacitive sensing detection, that is, the input terminal of the detection chip 2 is directly connected to the sensing panel 1. Reference is made to a schematic circuit diagram shown in FIG. 2, when a user wears the earphone, the casing of the earphone stem of the earphone is in contact with skin of the user, so that capacitive sensing is formed between the sensing panel 1 provided inside the earphone stem and the skin of the user to generate a sensing signal. After detecting the sensing signal, the detection chip 2 analyzes the sensing signal according to a preset analyzing algorithm, to determine a current wearing state of the earphone, such as a normal wearing state, an abnormal wearing state, or a non-wearing state. After determining the current wearing state of the earphone, the detection chip 2 transmit the wearing state to the control chip 3, and the control chip 3 adjusts an operating state of the earphone according to the wearing state. For example, when the earphone is in the normal wearing state, the earphone is controlled to operate normally. When the earphone is in the abnormal wearing state, the earphone is controlled to turn off or enter a low power consumption mode.

Specifically, when a user takes off the earphone, the detection chip 2 will detect that a sensing value of a sensing signal generated by the sensing panel 1 decreases rapidly, based on which it may be determined that the earphone is taken off. When the user puts the earphone in his/her hand, skin of the hand is in contact with the earphone stem at a position corresponding to the sensing panel 1. At this time, the sensing value of the sensing signal is larger than the sensing value during wearing, so it can be determined that the operating state is the non-wearing state. Other states may be determined by comparing detected sensing values with the sensing value during normal wearing, and the accuracy of detection can be ensured by a corresponding algorithm. In addition, reference can be made to corresponding methods in the conventional art for a detailed process of the detection chip 2 determining the wearing state of the earphone according to the sensing signal and a detailed process of the control chip 3 adjusting the operating state of the earphone according to the wearing state in the present disclosure, which will not be detailed in the present disclosure.

An encapsulating metal casing of a battery of an earphone is multiplexed as a sensing panel 1 for capacitive sensing detection in the present disclosure. There is no need to add an additional sensing area and space inside the earphone, which greatly utilizes the existing space, does not increase the volume of the earphone, and causes no influence to appearance design of a product. A surface area of the battery is larger, that is, a surface area of the sensing panel 1 is larger, so it can also be ensured that the sensing panel has a larger sensing area to improve the sensitivity and reliability of detection.

In an embodiment, the sensing panel 1 is provided with a detection lug, and a battery protection plate of the battery is provided with a detection interface corresponding to the detection lug. The input terminal of the detection chip 2 is connected to the detection lug through the detection interface, so that the detection chip 2 is connected with the sensing panel 1.

Figure 3:
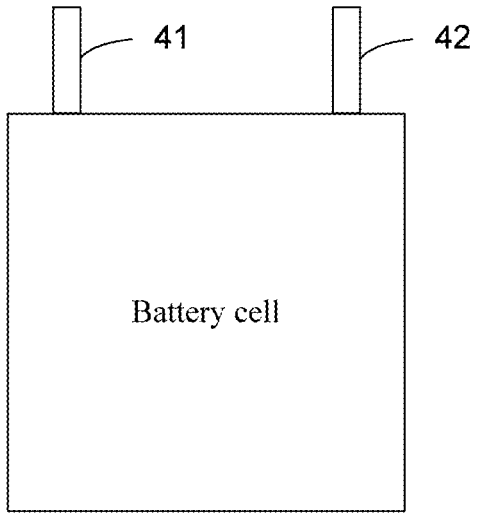
FIG. 3 is a schematic diagram of positive and negative lugs of a battery cell according to an embodiment of the present disclosure.
Figure 4:
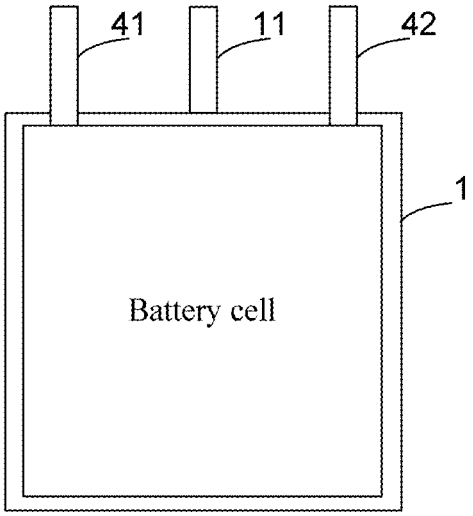
FIG. 4 is a schematic diagram of a detection lug of a sensing panel according to an embodiment of the present disclosure.
Figure 5:
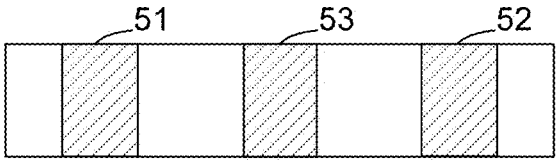
FIG. 5 is a schematic structural diagram of a battery protection plate according to an embodiment of the present disclosure.
Figure 6:
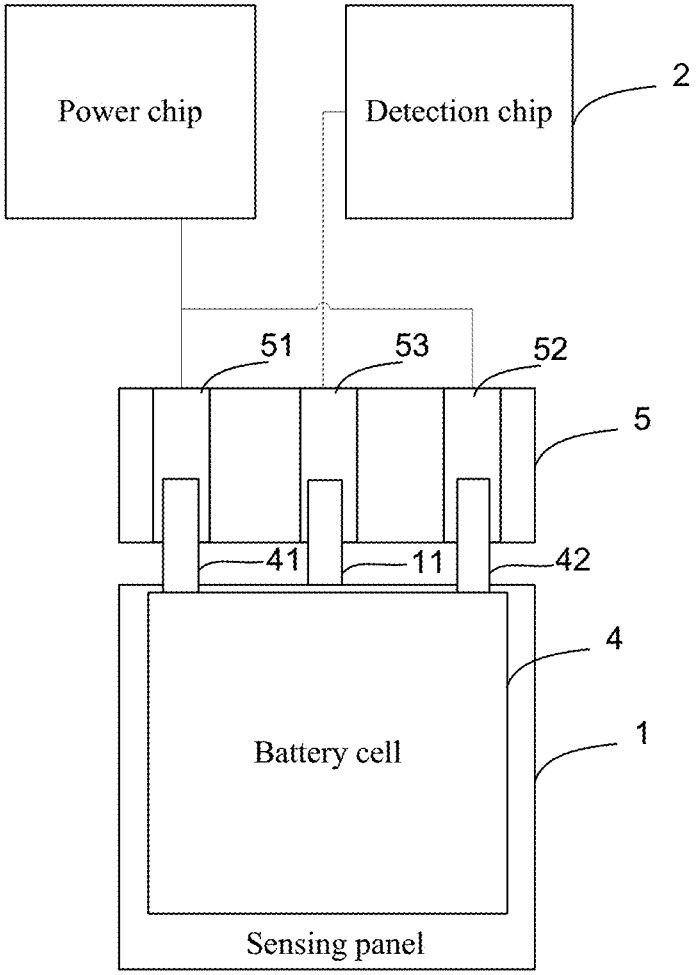
FIG. 6 is a schematic diagram of an overall structure of a detection chip and a sensing panel according to an embodiment of the present disclosure.

Specifically, the battery cell 4 of the earphone battery is provided with positive and negative lugs, that is, a positive lug 41 and a negative lug 42 (as shown in FIG. 3). The sensing panel 1 of the present disclosure is provided with a detection lug 11, that is, another pin is introduced from the sensing panel 1 as the detection lug 11 (as shown in FIG. 4). Correspondingly, the battery protection plate 5 is provided with a detection interface 53 (as shown in FIG. 5) besides a positive electrode 51 and a negative electrode 52 corresponding to the positive lug 41 and the negative lug 42 respectively. The positive lug 41, the negative lug 42, and the detection lug 11 are respectively connected (specifically, it can be connected by welding) with ends of the positive electrode 51, the negative electrode 52 and the detection interface 53 on the battery protection plate 5. The detection interface 53 may be configured as a sensing detection electrode of the detection chip 2, that is, the detection chip 2 may be connected with the sensing panel 1 through the detection interface 53 on the battery protection plate 5 (as shown in FIG. 6), so that the detection chip 2 may detect a sensing signal from the sensing panel 1.

In an embodiment, a surface of the sensing panel, for contact with skin of a user through a casing of the earphone stem when the earphone is worn, is an attaching surface, and an isolation layer is provided on an outside of each surface of the sensing panel except the attaching surface.

It should be noted that the sensing panel 1 in the present disclosure has multiple surfaces. When a user takes off the earphone or picks up the earphone, touch of a hand may have a certain influence on a sensor signal of the sensing panel 1, which may cause a false touch. Therefore, in order to reduce the occurrence of the false touch, an isolation layer is provided on an outside of each non-attaching surface of the sensing panel 1. A surface that contacts skin of a user through a casing of the earphone handle when the earphone is worn is an attaching surface, and the other surfaces are defined as non-attaching surfaces. After the isolation layer is provided on an outside of the non-attaching surface of the sensing panel 1, when the user takes off the earphone or picks up the earphone, contact surfaces between the hand and the earphone stem corresponds to the surfaces in the sensing panel 1 provided with the isolation layer, which can greatly reduce the influence on a sensing capacitance value.

In an embodiment, in order to save costs while ensuring the isolation effect, the isolation layer in the present embodiment may be an isolation layer made of foam. In practice, the isolation layer may be made of other materials, which may be specifically determined according to actual needs, and will not be specifically limited in the present disclosure.

In order to further save space and improve space utilization, in the present embodiment, the detection lug 11 and the positive and negative lugs provided on the battery cell 4 of the battery are located on the same side surface of the sensing panel 1, as. is shown in FIG. 4 with more details. The detection lug 11 may be provided in the middle of the positive lug 41 and the negative lug 42. Correspondingly, the detection interface 53 on the battery protection plate 5 is also provided in the middle of the positive electrode 51 and the negative electrode 52, corresponding to the detection lug 11.

In addition, the sensing panel 1 in the present disclosure may be a panel made with an aluminum-plastic film, that is, the encapsulating metal casing of the battery may be an aluminum-plastic film casing. In practice, the sensing panel 1 may be made of other materials, which may be specifically determined according to actual needs, and will not be specifically limited in the present disclosure, as long as the purpose of the present embodiment can be achieved.

It can be seen that a detection chip in the present disclosure is connected to an encapsulating metal casing of a battery provided inside an earphone stem of an earphone, and the encapsulating metal casing of the battery is multiplexed as a sensing panel. When a user wears the earphone, the earphone stem of the earphone is in contact with skin of the user, and a capacitance effect is formed between the sensing panel and the skin of the user, generating a sensing signal. Therefore a wearing state of the earphone may be determined by the detection chip through detecting the sensing signal of the sensing panel, so that the control chip may adjust an operating state of the earphone according to the wearing state. In the present disclosure, the encapsulating metal casing of the battery is multiplexed as a sensing panel without adding an additional sensing panel, which not only saves space and facilitates the miniaturization of the earphone, but also has a larger surface area of the battery and facilitates improving the sensitivity and reliability of wearing state detection.

On the basis of the foregoing embodiments, an embodiment of the present disclosure further provides an earphone, including an earphone stem, a battery provided in the earphone stem, and the earphone wearing detection device as described above.

In an embodiment, the earphone is a wireless Bluetooth earphone. Specifically, it may be a binaural wireless Bluetooth earphone with an earphone stem or a monaural wireless Bluetooth earphone. In practice, it may also be an earphone in any other form, which is not specifically limited.

It should be noted that the earphone in the embodiment of the present disclosure has the same beneficial effects as the earphone wearing detection device in the foregoing embodiments, and reference may be made to the above embodiments for the specific introduction of the earphone wearing detection device involved in the embodiment, which will not be repeated in the present disclosure.

The embodiments in the description are described in a progressive manner. Each of the embodiments mainly focuses on its differences from other embodiments, and reference may be made among these embodiments with respect to the same or similar parts.

It should also be noted that in the description, terms such as "including", "comprising" or any other variations thereof are intended to cover non-exclusive inclusion, so that a process, a method, an article or a device including a series of elements not only includes those elements, but also includes other elements that are not explicitly listed, or elements inherent to the process, the method, the article, or the device. If there are no more restrictions, an element preceding by the statement "including a . . . " does not exclude the existence of other same elements in the process, the method, the article, or the device that includes the element.

The above illustration of the disclosed embodiments can enable those skilled in the art to implement or use the present application. Various modifications to the embodiments are apparent to the person skilled in the art, and the general principle herein can be implemented in other embodiments without departing from the spirit or scope of the present application. Therefore, the present application is not limited to the embodiments described herein, but should be in accordance with the broadest scope consistent with the principle and novel features disclosed herein.

The invention claimed is:

1. An earphone wearing detection device, comprising:

a sensing panel forming an encapsulating metal casing of a battery, a detection chip with an input terminal connected to the sensing panel, and a control chip connected to an output terminal of the detection chip, wherein the battery is arranged in an earphone stem of an earphone, the detection chip is configured to detect a sensing signal of the sensing panel, and determine a wearing state of the earphone according to the sensing signal, and the control chip is configured to adjust an operating state of the earphone according to the wearing state.

2. The earphone wearing detection device according to claim 1, wherein the sensing panel is provided with a detection lug, a battery protection plate of the battery is provided with a detection interface corresponding to the detection lug, and the input terminal of the detection chip is connected to the detection lug through the detection interface, to connect the detection chip to the sensing panel.

3. The earphone wearing detection device according to claim 2, wherein a surface of the sensing panel, for contact with skin of a user through a casing of the earphone stem when the earphone is worn, is an attaching surface, and an isolation layer is provided on an outside of each surface of the sensing panel except the attaching surface.

4. The earphone wearing detection device according to claim 3, wherein the isolation layer is made of foam.

5. The earphone wearing detection device according to claim 3, wherein the sensing panel is made with an aluminum-plastic film.

6. The earphone wearing detection device according to claim 2, wherein the detection lug and positive and negative lugs provided on a battery cell of the battery are located on a same side surface of the sensing panel.

7. The earphone wearing detection device according to claim 6, wherein the detection lug is located in the middle of the positive and negative lugs.

8. The earphone wearing detection device according to claim 2, wherein the sensing panel is made with an aluminum-plastic film.

9. The earphone wearing detection device according to claim 1, wherein the sensing panel is made with an aluminum-plastic film.

10. An earphone, comprising an earphone stem, a battery provided in the earphone stem, and the earphone wearing detection device according to claim 1.

11. The earphone according to claim 10, wherein the sensing panel is provided with a detection lug, a battery protection plate of the battery is provided with a detection interface corresponding to the detection lug, and the input terminal of the detection chip is connected to the detection lug through the detection interface, to connect the detection chip to the sensing panel.

12. The earphone according to claim 11, wherein the sensing panel is made with an aluminum-plastic film.

13. The earphone according to claim 11, wherein the detection lug and positive and negative lugs provided on a battery cell of the battery are located on a same side surface of the sensing panel.

14. The earphone according to claim 13, wherein the detection lug is located in the middle of the positive and negative lugs.

15. The earphone according to claim 11, wherein a surface of the sensing panel, for contact with skin of a user through a casing of the earphone stem when the earphone is worn, is an attaching surface, and an isolation layer is provided on an outside of each surface of the sensing panel except the attaching surface.

16. The earphone according to claim 15, wherein the isolation layer is made of foam.

17. The earphone according to claim 15, wherein the sensing panel is made with an aluminum-plastic film.

18. The earphone according to claim 10, wherein the earphone is a wireless Bluetooth earphone.

19. The earphone according to claim 10, wherein the sensing panel is made with an aluminum-plastic film.

* * * * *